US009334727B2

(12) United States Patent
Jones et al.

(10) Patent No.: US 9,334,727 B2
(45) Date of Patent: May 10, 2016

(54) DOWNHOLE FORMATION FLUID CONTAMINATION ASSESSMENT

(75) Inventors: Christopher Michael Jones, Houston, TX (US); Robert E. Engelman, Katy, TX (US); Michael T. Pelletier, Houston, TX (US); Mark A. Proett, Missouri City, TX (US); Thurairajasingam Rajasingam, Kilcurry (IE)

(73) Assignee: Halliburton Energy Services, Inc., Houston, TX (US)

( * ) Notice: Subject to any disclaimer, the term of this patent is extended or adjusted under 35 U.S.C. 154(b) by 290 days.

(21) Appl. No.: 13/995,881

(22) PCT Filed: Jan. 6, 2011

(86) PCT No.: PCT/US2011/020312

§ 371 (c)(1), (2), (4) Date: Sep. 10, 2013

(87) PCT Pub. No.: WO2012/094007

PCT Pub. Date: Jul. 12, 2012

(65) Prior Publication Data

US 2013/0340518 A1 Dec. 26, 2013

(51) Int. Cl.
*E21B 49/08* (2006.01)
*E21B 49/00* (2006.01)

(52) U.S. Cl.
CPC ..... *E21B 49/08* (2013.01); *E21B 49/005* (2013.01); *E21B 2049/085* (2013.01)

(58) Field of Classification Search
None
See application file for complete search history.

(56) References Cited

U.S. PATENT DOCUMENTS

| | | | | |
|---|---|---|---|---|
| 2006/0139646 | A1* | 6/2006 | DiFoggio | 356/436 |
| 2007/0159625 | A1* | 7/2007 | DiFoggio | 356/328 |
| 2008/0030729 | A1* | 2/2008 | DiFoggio | 356/328 |
| 2009/0188668 | A1 | 7/2009 | DiFoggio | |
| 2010/0175873 | A1 | 7/2010 | Milkovisch et al. | |
| 2010/0245096 | A1 | 9/2010 | Jones et al. | |
| 2011/0042071 | A1 | 2/2011 | Hsu et al. | |
| 2011/0218736 | A1* | 9/2011 | Pelletier | 702/12 |

OTHER PUBLICATIONS

PCT International Search Report, mailing date of Search Report: Feb. 9, 2012, 3 pages PCT/US2011/020312, United States Patent and Trademark Office.

Office Action issued for Canadian Patent Application No. 2,823,687, dated Jun. 5, 2014.

* cited by examiner

*Primary Examiner* — Andre Allen
(74) *Attorney, Agent, or Firm* — Haynes and Boone, LLP

(57) ABSTRACT

The present invention relates to a method of detecting synthetic mud filtrate in a downhole fluid including placing a downhole tool into a wellbore, introducing a downhole fluid sample into the downhole tool, analyzing the downhole fluid sample in the downhole tool, producing at least two filtrate markers from the analyzing of the downhole fluid sample and converting the at least two filtrate markers by vector rotation to a sufficiently orthogonal signal. The first pumped fluid sample giving initial plateau readings can be a proxy for 100% drilling fluid having an initial orthogonal signal and subsequent samples can be converted to orthogonal signals that are referenced to the first pumped fluid signal to give a calculation of percent contamination of the formation fluid.

22 Claims, 7 Drawing Sheets

DOWNHOLE FORMATION FLUID CONTAMINATION ASSESSMENT

FIELD OF THE INVENTION

The present invention generally relates to the analysis of downhole fluids in a geological formation. More particularly, the present invention relates to apparatus and methods for analyzing the amount of drilling fluid filtrate present in a formation fluid sample.

BACKGROUND OF THE INVENTION

Hydrocarbon producing wells include wellbores that are typically drilled at selected locations into subsurface formations in order to produce hydrocarbons. A drilling fluid, which can also be referred to as "mud," is used during drilling of the wellbores. Drilling fluid is used in the drilling of a wellbore and it serves a number of purposes, such as cooling of the drill bit, carrying cuttings to the surface, provide pressure to maintain wellbore stability and prevent blowouts and the sealing off of the wellbore. The wellbore should be sealed to minimize the loss of drilling fluids into the formation. For safety purposes, a majority of the wellbores are drilling under over-burdened or overpressure conditions, i.e., the pressure gradient in the wellbore due to the weight of the mud column is greater than the natural pressure gradient of the formation in which the wellbore is drilled. Because of the overpressure condition, the mud penetrates into the formation surrounding the wellbore to varying depths, thereby contaminating the neutral fluid contained in the formation.

To minimize the loss of drilling fluids into the formation, components in the drilling fluid, such as clays, fillers and lost circulation materials, are used to restrict flow of the drilling fluids into the formation and to form a filter cake at the wellbore wall. The filter cake can provide a seal for the wellbore into the formation. Drilling fluids that have entered the formation to some extent have displaced the formation fluids, which can be referred to as drilling fluid filtrate.

The drilling fluids, or muds, used for drilling the wellbores can be water based or organic based. Organic based drilling fluids can be further distinguished as being natural based or synthetic based. For instance, organic based drilling fluids can include natural and/or synthetic hydrocarbons. A natural organic based drilling fluid is one where the primary component is a natural component that can include hydrocarbons, similar in nature to those usually produced from fields. Additionally with recirculation or reuse the drilling fluids can obtain components from the area. Natural organic based drilling fluids can include synthetic components that are added to impart certain properties. A natural organic based drilling fluid is one where the primary component is a natural organic material. A synthetic based drilling fluid is one where the primary component is a synthetic material. Both natural and synthetic based drilling fluids can therefore contain one or more synthetic material(s) that is distinct from the formation fluid that is naturally occurring in the formation. As well synthetic fluids can contain natural components that appear similar to the properties of formation fluid. A commonly used drilling fluid is oil based mud (OBM). OBM in the context herein should be understood to include synthetic-based oleic muds or natural based oleic muds, where synthetic, non-aqueous liquids are part of the base fluid.

Once a well is drilled it is desirable to obtain formation fluids from zones of interest to analyze and obtain properties thereof. If there is a drilling fluid filtrate that has contaminated the near wellbore area of the formation, this will alter the analysis of the samples being analyzed and will not be representative of the actual formation fluid. During a formation pumpout the first drawn fluid will be predominately drilling fluid filtrate. To minimize this contamination, fluids drawn from the formation are taken from an isolated area of the wellbore over time, which can be referred to as a pumpout. As the pumpout proceeds the degree of contamination in the samples should decrease over time and each subsequent sample should increase in formation fluid content and decrease in contamination content until a steady state is achieved.

Analysis, techniques and methods are known in the art that rely on monitoring changes in properties, such as density or resistivity and current optical methods, throughout the pumpout, curve fitting the results, such as through error function or arc tangent calculations, and obtaining steady state approximations with the assumption that when steady state is reached there is no contamination.

To estimate or determine the type of the fluid, including oil and/or gas and/or water and the characteristics of the fluid, in a formation at a particular wellbore depth and to estimate the condition of the reservoir surrounding the wellbore at the particular depth, downhole tools are used during drilling of the wellbore and after the wellbore has been drilled to obtain samples of the downhole fluid, also referred to as the formation fluid. The downhole tools for use in methods for analyzing downhole fluids can be conveyed into a wellbore via wireline tubing or coiled tubing, or any other suitable means. Methods of measuring using wireline conveyed tools, include lowering a wireline tool including an analyzer into a wellbore at a desired depth. These wireline tools may contain optical imaging tools for detecting the contents of downhole fluids. Other methods for analyzing downhole fluids include the method of logging while drilling (LWD) or measurement while drilling (MWD). LWD/MWD are techniques of conveying well logging tools and/or measurement tools, including downhole tools, into the wellbore hole as part of a bottomhole assembly. During drilling of the wellbore, these downhole tools are disposed in a bottomhole assembly above the drill bit. In some methods, LWD/MWD tools contain optical imaging tools for detecting the contents of downhole fluids.

To obtain a sample of formation fluid, a probe is often used to withdraw fluid from a formation. However, the formation fluid up to a certain depth adjacent to the wellbore can be contaminated with the mud or in other words contains mud filtrate. To obtain a clean sample of the formation fluid, the formation fluid is withdrawn for a certain period of time before taking the sample. Typically as drilling fluid is recycled in a well, the drilling fluid picks up characteristics of the well. Often times the drilling fluid is recycled within a field, and picks up characteristics of the field. Typically drilling fluid will contain between 10% to 90% of natural material from the field. However, the drilling fluid will often maintain some of the same characteristic of the base oil, making the amount of contamination of the formation fluid difficult to observe. Inaccurate readings of formation fluid samples can cause costly delays and expensive production shutdowns.

Current methods of formation fluid analysis of filtrate contamination during sampling rely on curve fitting of fluid analysis results until a near steady state composition is obtained, but a steady state composition can be obtained while still having significant or even majority contamination present.

Therefore, there is a need to give a real or near-real time determination of filtrate contamination in formation fluid sample. There is also a need to improve accuracy on determination of when filtrate contamination is at an acceptable level and to decrease the time involved in making such a determination.

DETAILED DESCRIPTION

The present invention relates generally to wellbore operations. More particularly, the present invention is applicable to both borehole investigative logging and to production logging. The present invention is applicable to downhole tools such as wireline tools and logging while drilling (LWD) or measurement while drilling (MWD) tools, well formation testing tools, drill-stem testing, as well as any other tool capable of being used in a downhole environment.

In wireline measurements, a wireline tool such as a downhole tool or logging tool, is lowered into an open wellbore on a wireline. Once lowered to the depth of interest, the measurements can be taken. LWD/MWD tools take measurements in much the same way as wireline-logging tools, except that the measurements are taken by a self-contained tool near the bottom of the bottomhole assembly and can be recorded as the well is deepened.

Figure 1:
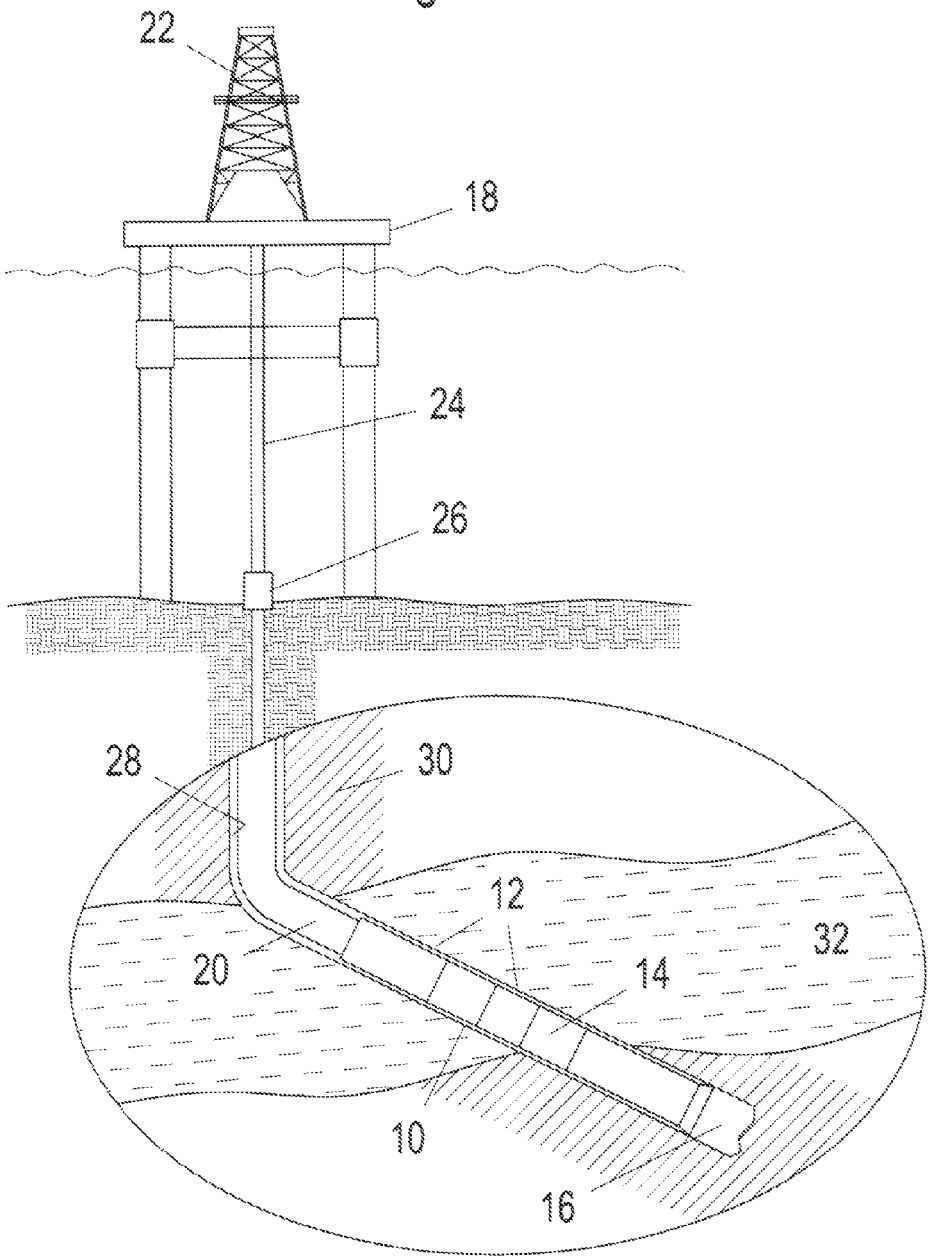
FIG. 1 illustrates a partial schematic and partial cross sectional side view of a wellbore containing a downhole tool of the invention.

FIG. 1 schematically depicts a downhole tool, here described as a formation fluid identification tool 10, as part of a bottomhole assembly 12, which includes a sub 14 and a drill bit 16 positioned at the distal most end of the formation fluid identification tool 10. During operation, as shown, the bottomhole assembly 12 is lowered from a drilling platform 18, such as a ship or other conventional platform, via a drill string 20. The drill string 20 is disposed through a riser 24 and a wellhead 26. Conventional drilling equipment (not shown) can be supported within a derrick 22 and can rotate the drill string 20 and the drill bit 16, causing the bit 16 to form a borehole 28 through the formation material 30. The drilled borehole 28 penetrates subterranean zones or reservoirs, such as reservoir 32. According to embodiments of the present invention, the formation fluid identification tool 10 may be employed in other bottom hole assemblies and with other drilling apparatus in land-based drilling, as well as offshore drilling such as the embodiment depicted in FIG. 1. In addition to the formation fluid identification tool 10, the bottom hole assembly 12 may contain various conventional apparatus and systems, such as a downhole drill motor, a rotary steerable tool, a mud pulse telemetry system, LWD/MWD sensors and systems, drill-stem test (DST) apparatus and others known in the art. In another embodiment, the formation fluid identification tool 10 and other components described herein may be conveyed down borehole 28 via wireline technology or on coiled tubing or any other suitable means.

Figure 2:
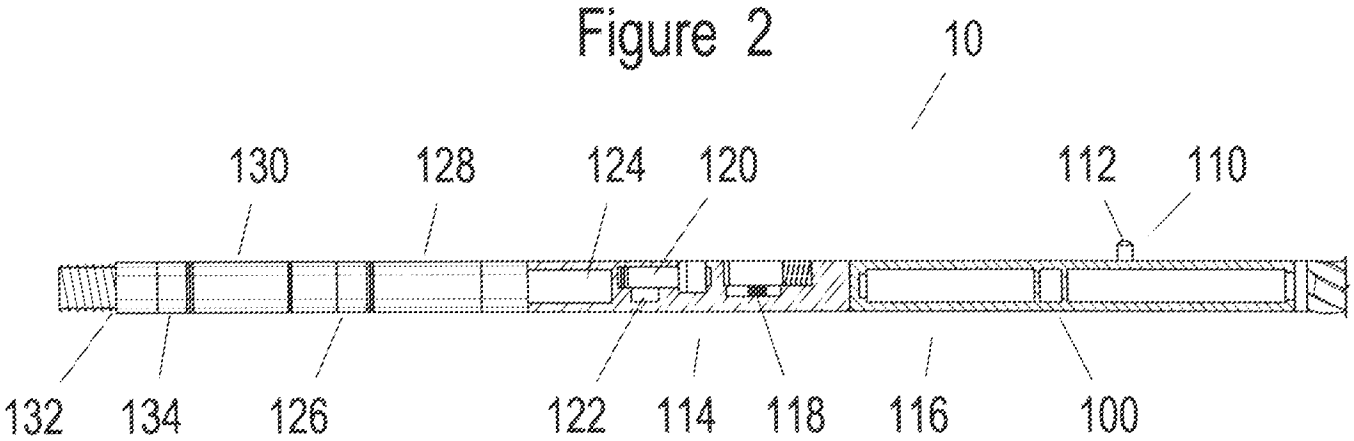
FIG. 2 depicts a partial schematic and partial cross-sectional view of one embodiment of an analysis tool.

Referring to FIG. 2, an embodiment of the formation fluid identification tool 10 is shown. A first end of the tool 10 includes a drill collar section 100, also referred to as the probe drill collar section 100. For reference purposes, the first end of the tool 10 at the probe collar section 100 is generally the lowermost end of the tool, which is closest to the distal end of the borehole. The probe collar section 100 may include a formation tester or formation probe assembly 110 having an extendable sample device or extendable probe 112. The tool 10 includes a second drill collar section 114, also referred to as the power drill collar section 114, coupled to the probe collar section 100 via an interconnect assembly 116. The interconnect assembly 116 includes fluid and power/electrical pass-through capabilities such that the various connections in the interconnect assembly are able to communicate, various fluids, electrical power, and/or signals to and from the probe collar 100 and the power collar 114.

In an embodiment, the power collar 114 may include the components of a flush pump assembly 118, a flow gear or turbine assembly 120, an electronics module 122 and a drilling fluid flow bore diverter 124. A third drill collar section 126, also referred to as the sample bottle drill collar section 126, may be attached to the power collar 114. The sample bottle collar 126 may include one or more sample bottle assemblies 128, 130. A fourth drill collar section 132, also referred to as the terminator drill collar section 132, may be attached to the sample bottle collar 126. The coupling between the sample bottle collar 126 and the terminator collar 132 may include an embodiment of an interconnect assembly 134. In an alternative embodiment, the terminator collar 132 and the interconnect assembly 134 couple directly to the power collar 114 if a sample bottle collar 126 is not needed. In an embodiment the formation fluid identification tool 10 can be used in conjunction with drilling, well formation testing or drill-stem testing operations.

Figure 3:
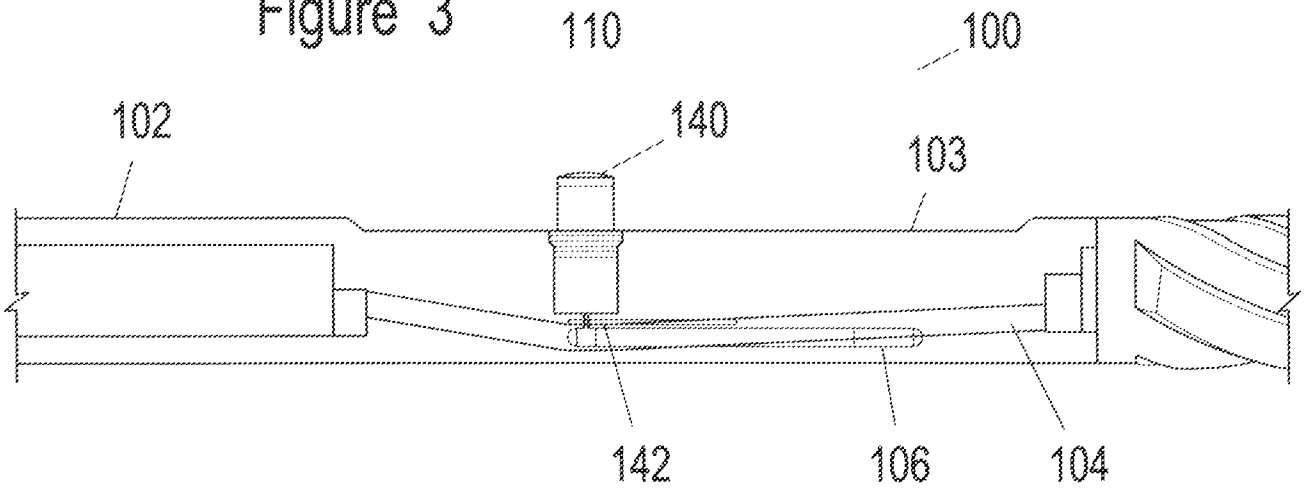
FIG. 3 depicts a partial schematic and partial cross-sectional view of one embodiment of a probe drill collar section of an analysis tool.
Figure 4:
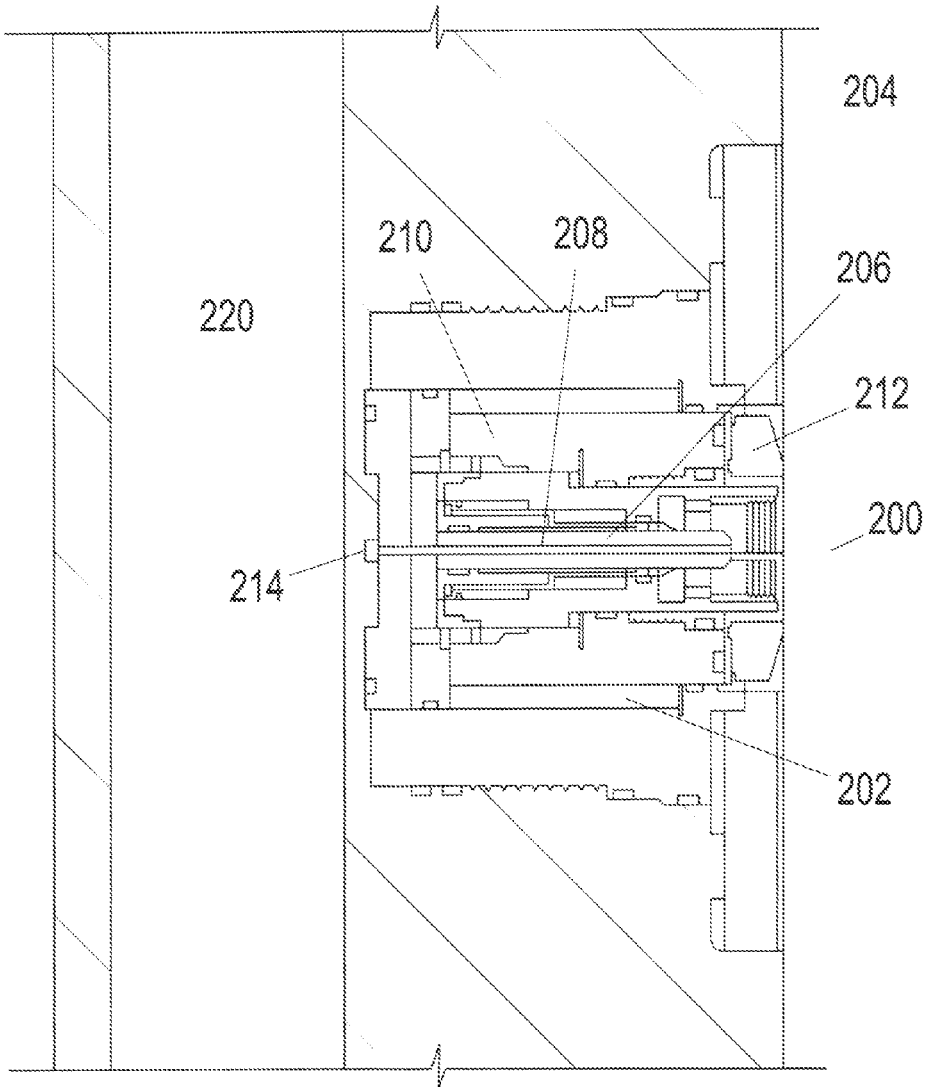
FIG. 4 is a cross-sectional view of one embodiment of an analysis probe.

Referring next to FIG. 3, an embodiment of the probe collar section 100 is shown in more detail. A drill collar 102 houses the formation tester or probe assembly 110. The probe assembly 110 includes various components for operation of the probe assembly 110 to receive and analyze formation fluids from the earth formation 30 and the reservoir 32. The probe member 140 is disposed in an aperture 142 in the drill collar 102 and is extendable beyond the drill collar 102 outer surfaces, as shown. The probe member 140 is retractable to a position that is flush with or recessed beneath the drill collar 102 outer surfaces, as shown in FIG. 4. The probe assembly 110 may include a recessed outer portion 103 of the drill collar 102 outer surface that is adjacent the probe member 140. The probe assembly may include a sensor 106 for receiving formation fluid from the probe member 140. The formation fluid is communicated from the probe member 140 to the sensor 106 via a flowline (not depicted) for measurement of the formation fluid. Also shown is a drilling fluid flow bore 104 through which drilling fluid can pass.

In an embodiment, the downhole tool 10 contains a probe collar section 100 that includes a flowline, which can be a tube or the like, that is isolated from the wellbore environment. The function of the downhole tool 10 is to retrieve a formation fluid sample by pulling formation fluid from the formation using the probe member 140 of the probe collar section 100. The formation fluid sample retrieved by the probe member 140 is sent through the flowline to a sample analyzer, or sensor 106, situated within the downhole tool 10. The downhole tool 10 also contains an outlet flowline (not depicted), which is used to remove the tested sample from the downhole tool 10 to the wellbore environment. The downhole tool 10 may also include pump(s) (not depicted) for moving the formation fluid sample throughout the downhole tool.

In referring to FIG. 4, an alternative embodiment is shown as probe 200. The probe 200 is retained in an opening 202 in drill collar 204. Any alternative means for retaining the probe 200 are consistent with the teachings herein, as understood by one having ordinary skill in the art. The probe 200 is shown in a retracted position, not extending beyond the outer surface of the drill collar 204. The probe 200 may include a stem 206 having a passageway 208, and a piston 210. The end of the piston 210 may be equipped with a seal pad 212. The passageway 208 communicates with a port 214, which communicates with the flowline (not shown) for receiving and carrying a formation fluid to the sample analyzer, or sensor (not shown). Also shown is a drilling fluid flow bore 220 that enables the flow of drilling fluid through the drill collar 204 without contact with the probe assembly 200.

Figure 5:
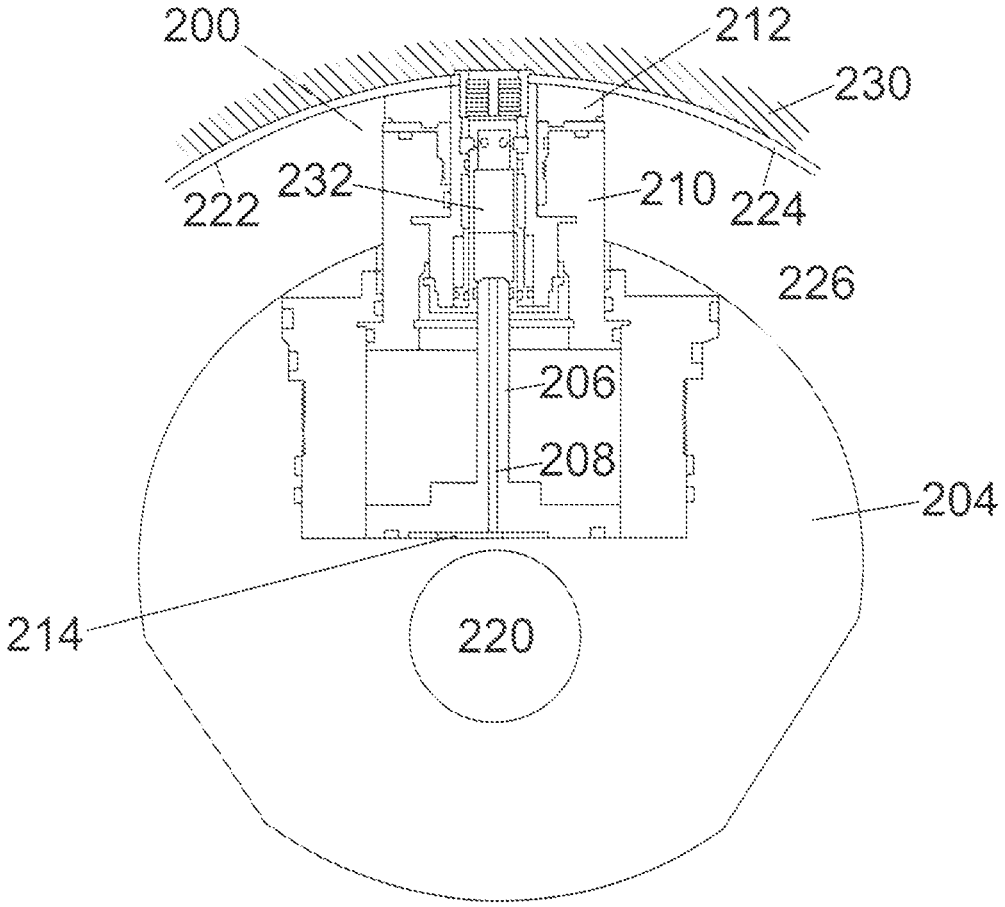
FIG. 5 depicts an alternative cross-section view of the probe of FIG. 4 in an extended position.

In reference to FIG. 5, the probe 200 is shown in an extended position. The piston 210 is actuated from a first position shown in FIG. 4 to a second position shown in FIG. 5. The seal pad 212 is engaged with the borehole wall surface 222, which may include a mud or filter cake 224, to form a primary seal between the probe 200 and the borehole annulus 226. The probe 200 may be actuated to withdraw formation fluids from the formation 230, into a bore 232, into the passageway 208 of the stem 206 and into the port 214. Also shown is a drilling fluid flow bore 220 that enables the flow of drilling fluid through the drill collar 204 without contact with the probe assembly 200.

The seal pad 212 is can be made of an elastomeric material. The elastomeric seal pad 212 seals and prevents drilling fluid or other borehole contaminants of the borehole annulus 226 from entering the probe 200 during formation testing.

The accuracy of the measurements taken by downhole tools may depend upon the amount of contamination in the sample taken. Drilling fluids used in the drilling of a wellbore may lead to the development of drilling fluid filtrate in the formation. The drilling fluid filtrate may mix with the formation fluid that is to be tested, resulting in contaminated samples. The contamination of the samples can alter the analysis of the samples being analyzed, causing the sample to not be representative of the actual formation fluid.

The methods of the present invention enable the determination of the contamination content of a formation fluid sample downhole without curve fitting. During the analyzing of the pumpout, signal responses are taken and at least one sufficiently orthogonal signal is formed by vector rotation of two or more signal responses. The sufficiently orthogonal signal can then be used to determine the contamination content of a formation fluid sample. The sufficiently orthogonal signal can determine if there is contamination content even if a steady state condition is reached. If there is still contamination, testing conditions can be altered, such as reducing the flow rate, to obtain subsequent samples that can be analyzed to determine if lower contamination content has been achieved.

According to aspects of the invention, as drilling fluid is recycled in a well, the drilling fluid may pick up constituents of formation fluids within that well. Also, as drilling fluid is recycled within a field, the drilling fluid may pick up the characteristics of the field. A drilling fluid may contain of from 10% to 90% natural material from the field, such as formation fluid. However, this contaminated drilling fluid (containing natural material) will maintain some of the same characteristics of the base oil of the drilling fluid. When the base oil is distinct from the contaminated drilling fluid, a response for the 100% drilling fluid filtrate can be characterized even after contamination by using a first pumped fluid sample as a proxy for 100% drilling fluid. The first pumped fluid sample is analyzed and the initial plateau readings are considered to be all drilling fluid. All fluid pumped thereafter can be referenced to the first pumped fluid initial plateau for a discrete calculation of percent contamination. Since a discrete value for contamination can be assigned via orthogonal vector rotation then so can the pure formation fluid signal. The estimate for the pure formation fluid signal improves as the concentration of formation fluid increases but reduces as the signal from the pure mud vanishes. Therefore, the best estimates of a pure formation fluid signal are when a sufficient mixture of drilling fluid filtrate and formation fluid is achieved which will take place at some point in the pumpout sampling.

An aspect of the present invention is obtaining signal markers, or more specifically vector responses, of pure component end members. The pure component end members represent the initial plateau readings considered to be 100% proxy drilling fluid and the estimate of 100% pure formation fluid. Comparing signal responses to previous signal responses acquired from samples with almost the same matrix is a useful way to analyze the variation, such as samples from the same field. Essentially the matrix effects between the two analyzed samples are almost identical. Also the system effects and instrument effects are often closer in response to each other, for example the light source and detector have not drifted, and the index of refraction of the oil is practically identical. Integrating this difference spectrum over short time intervals (as defined by the pumpout conditions) allows a more stable signal over the course of the entire pumpout.

The determination of pure formation fluid character is important because at some point in the pumpout the concentration of filtrate markers might drop below a tolerable determinable threshold. With both end members of the pumpout determined, a calculation of filtrate contamination may still take place. The calculation of filtrate contamination may take place without the determination of the pure components of the drilling fluid or formation fluid and may proceed only with the signals. This results in a transfer of calibration requirements from that of component properties to that of changing signal responses. The precision of signals can be enhanced through the stacking of signals. The stacking of signals refers to the combination of multiple signals into one signal.

In an embodiment, the downhole tools of the present invention, including the wireline, tubing conveyed and LWD/MWD tools, contain a sample analyzer for analyzing a sample of formation fluid. The downhole tools may also contain a pump and flow lines for retrieving a formation fluid sample from the formation, sending the sample to the sample analyzer and removing the sample from the downhole tool after it has been analyzed.

In an embodiment, the sample analyzer can include any known type of sample analyzer. In another embodiment, the sample analyzer may be selected from a density analyzer, an electrochemical analyzer, a fluorescence analyzer, an optical analyzer, and an acoustic analyzer and combinations thereof. In an embodiment, the sample analyzer may include an optical analyzer, such as a spectrometer. In an embodiment the spectrometer includes a light source and a detector. The light source and detector may be selected from all available spectroscopy technologies. In an embodiment, the sample analyzer may include one or more photometric sensor. In an embodiment, the analyzer contains optical and non-optical sensors.

In an embodiment, the step of analyzing includes spectroscopy. In an embodiment, any available spectroscopy method can be used in the present invention. In an embodiment, the spectroscopy is selected from the group of absorption spectroscopy, fluorescence spectroscopy, X-ray spectroscopy, plasma emission spectroscopy, spark or arc (emission) spectroscopy, visible absorption spectroscopy, ultraviolet (UV) spectroscopy, infrared (IR) spectroscopy, near-infrared (NIR) spectroscopy, fluorescence spectroscopy, selectively tuned mass spectroscopy, Raman spectroscopy, coherent anti-Stokes Raman spectroscopy (CARS), nuclear magnetic resonance, photoemission, Mössbauer spectroscopy, acoustic spectroscopy, laser spectroscopy, Fourier transform spectroscopy, and Fourier transform infrared spectroscopy (FTIR) and combinations thereof. In another embodiment, the spectroscopy is selected from the group of infrared (IR) spectroscopy, near-infrared (NIR) spectroscopy, Fourier transform spectroscopy, and Fourier transform infrared spectroscopy (FTIR) and combinations thereof. In a specific embodiment, the spectroscopy is selected from infrared (IR) spectroscopy.

In an embodiment the light source may be selected from the group of a tunable source, a broadband source (BBS), a fiber amplified stimulated emission (ASE) source, black body radiation, enhanced black body radiation, a laser, infrared, supercontinuum radiation, frequency combined radiation, fluorescence, phosphorescence, and terahertz radiation. A broadband light source is a source containing the full spectrum of wavelengths to be measured. In an embodiment, the light source can include any type of infrared source.

In an embodiment the light source can include a laser diode array. In a laser diode array light source system, desired wavelengths are generated by individual laser diodes. The output from the laser diode sources may be controlled in order to provide signals that are arranged together or in a multiplexed fashion. In an embodiment having a laser diode array light source, time and/or frequency division multiplexing may be accomplished at the spectrometer. In an embodiment, a one-shot measurement or an equivalent measurement may be accomplished with the laser diode array. In an embodiment, either a probe-type or sample-type optical cell system may be utilized.

In an embodiment, the spectrometer includes detectors, which act as sensors detecting the light emitted from the light source after the light passes through a sample. The effectiveness of the detectors of the spectrometer may be dependent upon temperature conditions. As temperatures increase, the detectors can become less sensitive. The detectors of the present invention may include an improvement in detector technology. In an embodiment, the detectors of the present invention may have reduced thermal noise and can have an increased sensitivity to the emitted light. In an embodiment, the detector is selected from the group of thermal piles, photoacoustic detectors, thermoelectric detectors, quantum dot detectors, momentum gate detectors, frequency combined detectors, high temperature solid gate detectors, detectors enhanced by meta materials such as infinite index of refraction optical element.

In an embodiment, the spectroscopy of the present invention includes conventional IR spectroscopy. In conventional IR spectroscopy, the light source can also include a splitter. In such an embodiment the light that is emitted from the light source is split into two separate beams in which one beam passes through a sample and the other beam passes through a reference sample. Both beams are subsequently directed to a splitter before passing to the detector. The splitter quickly alternates which of the two beams enters the detector. The two signals are then compared in order to detect the composition of the sample.

In an embodiment, the spectroscopy may be performed by a diffraction grating or optical filter, which allows selection of different narrow-band wavelengths from a white light or broadband source. In an embodiment, a method of utilizing a broadband source is in conjunction with Fiber Bragg Grating (FBG). FBG includes a narrow band reflection mirror whose wavelength can be controlled by the FBG fabrication process. In an embodiment the broadband light source is utilized in a fiber optic system. In an embodiment, the fiber optic system contains a fiber having a plurality of FBGs. In such an embodiment, the broadband source is effectively converted into a plurality of discrete sources having desired wavelengths.

In an embodiment, the spectroscopy of the present invention includes Fourier spectroscopy. Fourier spectroscopy, or Fourier transform spectroscopy, is a method of measurement for collecting spectra. In Fourier transform spectroscopy, rather than passing a monochromatic beam of light through a sample as in conventional IR spectroscopy, a beam containing multiple different frequencies of light is passed through a sample. This spectroscopy method then measures how much of the beam is absorbed by the sample. Next, the beam is modified to contain a different combination of frequencies, giving a second data point. This process is repeated many times. After the beams of light have been passed through the sample, the resultant data is sent to a computer, which can infer from the data what the absorption is at each wavelength. In an embodiment, the beam described above is generated by a broadband light source. The light emitted from the broadband light source shines into a designated configuration of mirrors, also known as an interferometer, that allows some wavelengths to pass through but blocks others, due to wave interference. The beam is modified for each new data point by moving one of the mirrors; this changes the set of wavelengths that pass through. As mentioned above, computer processing is used to turn the raw data, which includes the light absorption for each mirror position into the desired result, which includes light adsorption for each wavelength. This processing is also known as "Fourier transform" and the raw data is referred to as the "interferogram." When Fourier spectroscopy is utilized, a scanning process is needed to create the interferogram. That is, the spectrometer internally generates a fixed and variable length path for the optical beam and then recombines these beams, thereby generating optical interference. The resulting signal includes summed interference pattern for all frequencies not absorbed by the sample. As a result, the measurement system is not a one-shot type system, and hence the sampler-type probe is preferred for use with this type of spectrometer. In an embodiment, the Fourier spectroscopy is performed utilizing any known light source.

In an embodiment, the spectroscopy of the present invention is a Fourier spectroscopy utilizing an IR light source, also referred to as Fourier transform infrared (FTIR) spectroscopy. In an embodiment, IR light is guided through an interferometer; the IR light then passes through a sample; and a measured signal is then obtained, called the interferogram. In an embodiment Fourier transform is performed on this signal data, which results in a spectrum identical to that from conventional infrared spectroscopy. The benefits of FTIR include a faster measurement of a single spectrum. The measurement is faster for the FTIR because the information at all frequencies is detected simultaneously. This allows multiple samples to be collected and averaged together resulting in an improvement in sensitivity.

Optical based signals have been mentioned thus far, however, other non-optical based sensors may be utilized in the present invention. In an embodiment, a sensor based on markers or signals present in drilling fluid may be utilized. In an embodiment, the non-optical based sensors utilized include a ketone sensor based, an ester sensor based, and/or an olefin sensor based signal. In an embodiment, the sensor can be a selectively tuned mass spectrometer. In an embodiment, the data obtained from the selectively tuned mass spectrometer, ketone sensor based, ester sensor based, and/or olefin sensor based signals can be used to measure the percent contamination of drilling fluid within a formation fluid sample. As long as the marker or signal changes during the pumpout, the signals can be measured, the difference of signals over a time series determined, and these changes manipulated and used to measure the percent contamination without having to curve fit readings over time.

In an embodiment, differing sensors, both optical and non-optical, can be used throughout the pumpout to maximize sensitivity. In an embodiment, the pumpout is analyzed by spectroscopy, acoustics, electrochemical measurements, density measurements, photometric, and/or fluorescence. In an embodiment, density measurements can be used to correlate with optical signals to maximize sensitivity. In another embodiment, fluorescence can be used for a specific signal as double bonds can have fluorescence properties.

In an embodiment, a sample is obtained downhole from an isolated section of a wellbore wall by a probe section of a downhole tool. The sample is sent from the probe section to an analyzer within the downhole tool. The sample flows through the analyzer where it is exposed to light in the mid-IR spectrum that produces a first response spectral signal of signal magnitude versus wavelength. The first pumped fluid can be used as a proxy for 100% drilling fluid. In an embodiment, the first sample, or first pumped fluid, is greater than 10% drilling fluid. In another embodiment, the first sample is of from 25% to 95% drilling fluid. In a further embodiment, the first sample is of from 90% to 100% drilling fluid. After the first sample is analyzed, subsequent samples are then taken and analyzed. The subsequent samples also flow through the analyzer where each sample is exposed to light in the mid-IR spectrum that produces a first response spectral signal of signal magnitude versus wavelength. The percent contamination of the sample is calculated by comparing the data from the proxy to the subsequent samples. In an embodiment, the calculation is performed without having to curve fit readings over time. In an embodiment, 2 or more spectral signals are converted by vector rotation to a sufficiently orthogonal signal to determine the percent contamination of the sample.

In an embodiment the first pumped fluid can be used as a proxy for 100% drilling fluid. In an embodiment alternate embodiment the sample measurements can be reverse curve fitted to extrapolate back to a 100% drilling fluid end point.

In an embodiment during pumpout one or more sample measurements, such as density, are taken and flows of substantially unaltered formation fluid, which can be referred to as vugs, are observed. These vugs may have been located in a portion of the formation that was isolated from the contamination of drilling fluid filtrate, but were dislodged during the pumpout and pass through the sensors as flows of substantially unaltered formation fluid. If detected these vugs and the sample measurements form them can be used as proxy for the end point of unaltered formation fluid.

The drilling fluids may include natural or synthetic drilling fluids or combinations thereof. In an embodiment, the natural drilling fluids are selected from the group of diesel, mineral oil, field oil, and crude oil and combinations thereof. In an embodiment, the natural drilling fluids further include synthetic additives. The synthetic additives may contain ketones, alcohols, organic acids, or any blends thereof. In an embodiment, the synthetic drilling fluids contain esters, olefins, cross-linked polymers or combinations thereof. In an embodiment, the esters, olefins, or ketones may be used as fingerprints or markers of drilling fluid contamination in the formation fluids being analyzed. In an embodiment, the synthetic drilling fluids contain unknown synthetic components that can be used as a further indicator of contamination. Non-limiting examples of components that may be present and used as markers can include: emulsifiers such as an amide or an amide containing compound; wetting agents such as phosphorus or a phosphorus containing compound; corrosion inhibitors, such as amine, thiocyanate, or phosphorus and compounds containing them; lubricants such as an ester or an ester containing compound; base oils such as an ester or an ester containing compound; and fluid loss additives such as an ester or an ester containing compound.

In an embodiment, the OBM present in the pumpout can be identified by the presence of certain components present in OBM, but not present in natural formation fluid. These certain components are synthetics or additives of OBM can be identified by their spectral signals. In an embodiment, these components are selected from esters, ketones, and olefins and combinations thereof. Esters, ketones and olefins are optically distinct from natural oils in the mid IR range. These chemicals are major constituents of synthetic based drilling fluid but are not present naturally in a reservoir. In effect they can act as chemical markers for absolute mud filtrate determination and therefore can be identified as unique synthetic mud markers. Their spectral signals can be monitored throughout the pumpout and can be used to determine when drilling fluid contamination has decreased to a sufficient degree. They can be used to determine the end point of the pumpout as mentioned above. Although signals due to the components of esters, ketones and olefins have been identified as unique mud markers, if other signal markers can be identified during the pumpout they too may be used for contamination level calculations.

In an embodiment, the overall spectral signal obtained can be converted to a unique synthetic fingerprint. In an embodiment, the unique synthetic fingerprint is an orthogonal or sufficiently orthogonal signal fingerprint. During pumpout the orthogonal synthetic fingerprint decreases at a rate similar to the specific synthetic OBM components or to that of an additive to a synthetic drilling fluid, therefore it can be used to measure the percent contamination without having to curve fit readings over time. In one embodiment, in order to identify a signal fingerprint the maximum orthogonal descent and/or ascent is calculated.

In an embodiment, in addition to the overall spectral signal, any 2 or more spectral signals can be converted by vector rotation to a unique orthogonal synthetic fingerprint, as long as there is a linear relation between the signal change and the component concentration. In an embodiment a ketone spectral signal and an olefin spectral signal are present and their signals can be combined and converted by vector rotation to form a unique orthogonal synthetic fingerprint that will change in relation to the decrease of both signals during pumpout.

Embodiments can include a combination of spectral and non-spectral signals. The more signals that are available for use, the greater the precision. In an embodiment, spectral signals are combined with signals from density measurements, ketone sensor based, ester sensor based, olefin sensor based signals, signals from acoustic measurements, signals from fluid conductivity, and fluorescence signals. In another embodiment, the spectral signals are combined with signals from density measurements with at least one of ketone sensor based, ester sensor based, olefin sensor based signals.

Signal responses, whether measured by spectroscopy and/or another method, can be sent to a processor. In an embodiment, the processor can be operated to determine the component concentration of the fluid samples through the application of processing techniques. In an embodiment, the processing techniques include any known computational method. In an embodiment, any suitable processing techniques can be used to define the orthogonal variations. In another embodiment, the processing techniques include least squares analysis, partial least squares regression (PLS), multivariate optical element (MOE), principal component analysis (PCA), principal component regression (PCR), multiple linear regression (MLR), classical least squares (CLS), analysis of variance (ANOVA), varimax rotation, singular value decomposition (SVD), multivariant curve resolution (MCR), Eigenvector Projection, chemometric methods, and mixture analysis, and combinations thereof Multivariant Curve Resolution (MCR) is one desirable method that can be used as a processing technique to define the orthogonal variations of signals of the present invention. MCR is a chemometric technique that can be used to resolve an experimental matrix of channel-correlated responses (such as optical spectra, mass spectra, or chromatograms) into pure response vectors. As applied to optical spectra the technique is designed to deconvolute the response of spectra of mixtures into a linear combination of pure component spectra and a matrix of pure component concentrations. The technique can only handle nonlinear spectral effects with the pretreatment of the pure component matrix. The advantage of the technique is the ability to handle constraints in the component domain and spectral domain simultaneously with an alternating least squares algorithm. Often when performing the mixture analysis, where one or more pure components is not strictly measured, the mathematical solution is undetermined, i.e. C*S=X has an infinite number of solutions where C is the concentration matrix, S is the pure component spectra and X is the experimental matrix. Determination of C*Sest=X+R may be determined, with Sest being an estimate of the pure competent spectra and where R is the residual matrix, by minimizing R and applying constraints to the C and S matrix. When constraints can be applied to the C and Sest matrices, often an explicit solution may be found.

Constraints can be applied such as through the physical knowledge of the system. For instance a common set of constraints applied to MCR solutions are positive spectral and positive concentration constraints. Typically these constraints only lead to a bounded solution with an upper most and lower most spectral and concentration estimate. Closure constraints are often employed for a mixture in which the sum of volume components is assumed to be additive and the total sum of volumes must equal 100%. Although application of either constraint alone may lead to a boundary that may overlap with a null result (e.g. upper limit of mud contamination in a flow line is 10% but the actual concentration may be zero), the application of both constraints together often leads to a better bounded solution that does not necessarily overlap with the null result (e.g. maximum mud concentration is 10% and lower limit is 5%). In some cases the positive spectral and concentration constraints may lead to a unique solution for which the estimate is as certain as the ratio of variance not captured vs. that captured (e.g. the mud contamination is 7.5%+/−1%). The last scenario occurs in a dissatisfactory low number of cases. However, many additional natural or assumed constraints may be applied either internal to the mathematics of the solution, or externally in the minimization routine of the algorithm to obtain a discrete solution. Typically the more constraints that may be applied, the more narrow the bounds of the solution, and the more likely a discrete solution will be found.

Constraints that may be applied include full spectral and concentrations constraints of one of the end members (e.g. assumption that the fluid that first passes by a spectral sensor in a flow line is 100% drilling fluid filtrate), baseline constraints (certain spectral regions are known not to respond for a given component), non zero constraints if some spectral regions are known to respond to a component, smoothing constraints requiring certain spectral regions to monotonically increase or decrease, smooth constraints requiring that concentrations monotonically increase or decrease (typically mud filtrate decreases in a pumpout and formation fluid increases), and concentration ratio constraints requiring that certain concentrations maintain a fixed distribution. Constraints that may be applied include spectral ratio constraints requiring that certain known spectral regions maintain a fixed ratio (e.g. methane peak at 1680 and methane peak at 2300), unity constraints requiring that the sum of the components equal a fixed volume, additional sensor curve shape constraints (e.g. from a density sensor or a resistivity sensor or a capacitance sensor etc.), and physical constraints (for instance from phase behavior or equation of state models). MCR offers a convenient platform for the combination of a large amount of system information to provide a solution.

MCR uses principal maximal orthogonal descent where the spectral variations of greatest change are weighted more, and maximum variance distribution of the results after the orthoginalization of pure component spectra are rotated, to capture as much independent concentration information as possible given constraints. Minor limitations include knowledge of the number of relevant factors i.e. components or spectral artifacts, and the necessity that all channel responses be geometrically linear with respect to the component concentrations. The limitation may be tested with standard factor analysis. If it is found that more than an expected number of factors are influencing the response, one may use any known technique, such as varimax rotation of the principal components as a proxy for higher order spectral contribution, to facilitate the analysis. If the responses of sensors are not linear with respect to pure component concentration then the concentration or response matrix must be linearized ahead of the MCR. For instance resistance may be converted to conductivity, or optical saturation between 1.5 and 3.0 OD units may be geometrically expanded, or nonlinear regimes of responses may be treated as missing data while retaining those that fall within a linear regime. This is another advantage of MCR in that missing data may easily be handled.

To normalize signals across the signal matrix signals that do not have a linear relationship with the fluid contamination may need to be forced into a linear or substantially linear relationship through signal processing methods. In an embodiment, the signal possessing may proceed mathematically if the signal at a particular channel is defined as:

$$R=B_1C+B_0$$

wherein R is the response C is the concentration of a component and $B_1$ is the calibration constant, and $B_0$ is a system constant that can drift over a long time such that $B_0=B(t)$, but over short times $B_0$ is approximately constant. The concentration change of components over time can be described by a parametric equation of perhaps second order:

$$C=A_2t^2+A_1t+A_0$$

Therefore over a short time:

$$R=B_1A_2t^2+B_1A_1t+B_1A_0+B_0$$

Wherein $B_1A_0+B_0$ is approximately a constant. Taking the derivative:

$$R'=2B_1A_2t+B_1A_1$$

Integrating and setting all 0 order constants equal to zero (or a proper value):

$$R=B_1A_2t^2+B_1A_1t$$

The system effects have dropped out of the equation at the expense of adding noise to the curve (differential signals tend to be more susceptible to noise), however, with long term drift removed the signal may be stabilized over longer time periods. The derivative and integration approach is only one example of comparing signals over a time series. Another approach that can be useful is taking the ratio of signals over a time series or the ratio of a difference of signals over a time series.

If an initial plateau of signals is not obtained during cleanup, the readings and the calculations described above can be used to back calculate from curve fitting an estimated initial plateau and a calculated initial end point. The calculated initial end point can then be used in the analysis as described above.

In an embodiment, the present invention includes a method to calculate the contamination level during a pumpout without curve fitting readings. Two or more signal responses are manipulated, such as through vector rotation to form a unique orthogonal synthetic fingerprint, and this fingerprint is used to measure the percent contamination of a sample.

The present invention includes a method for detecting synthetic mud filtrate in a downhole fluid. The method for detecting synthetic mud filtrate in a downhole fluid includes the steps of passing a downhole fluid sample through an analyzer, analyzing the downhole fluid sample, producing at least two filtrate markers from the analysis, and converting the at least two filtrate markers by vector rotation to a unique orthogonal synthetic fingerprint. In an embodiment, a first pumped fluid sample is analyzed giving initial plateau readings that are a proxy for 100% drilling fluid wherein all fluid pumped thereafter (the pumpout) is analyzed giving readings that are referenced to the first pumped fluid initial plateau for a discrete calculation of percent contamination. In an embodiment, the percent contamination is obtained without curve fitting the readings following the initial plateau over time. In an embodiment, the step of analyzing the downhole fluid sample is conducted downhole. In an embodiment, the method for detecting synthetic mud filtrate in a downhole fluid is continuous. In an embodiment, the downhole fluid sample includes formation fluid and mud filtrate. In an embodiment the downhole fluid sample includes of from 10% to 90% of formation fluid. In a further embodiment the formation fluid sample is obtained from a formation, sent to the analyzer, subjected to analysis, and then discharged to the wellbore downhole. In an embodiment, the downhole fluid sample is not removed from the downhole environment during the method of measuring.

In an embodiment, the method for detecting synthetic mud filtrate in a downhole fluid includes the steps of passing a downhole fluid sample through an analyzer, analyzing the downhole fluid sample by illuminating the downhole fluid sample with light from a light source and detecting light passing through the downhole fluid sample, and measuring the detected light to produce one or more filtrate markers. In another embodiment, the light emitted from the light source is of a sufficient band to detect esters, ketones and/or olefins. In a further embodiment, the light emitted from the light source is IR light in the mid-range, or MIR.

In an embodiment, the method for detecting synthetic mud filtrate in a downhole fluid includes the step of analyzing a downhole fluid sample by using sensors selected from the group of ketone based, olefin based, and ester based, and any other synthetic additive for which a sensor yields a unique signal, and combinations thereof. In another embodiment, the step of analyzing is performed by non-optical sensors. In a further embodiment, the non-optical sensors are selected from the group of acoustic measurements, density measurements, fluid resistivity or fluid conductivity and combinations thereof. In an embodiment, the method for detecting synthetic mud filtrate in a downhole fluid includes the step of analyzing the downhole fluid sample by using a combination of optical and non-optical signals.

In an embodiment, the data is analyzed by comparing signal responses to previous signal responses acquired from samples having essentially the same matrix. In an embodiment, the calculation of filtrate contamination may take place without the determination of the pure components of the drilling fluid or formation fluid and may proceed only with signal responses. In an embodiment the signals are stacked.

In an embodiment, the present invention also includes a method of analyzing a synthetic mud contaminated formation fluid utilizing spectroscopy. The method of analyzing a synthetic mud contaminated formation fluid utilizing spectroscopy includes the steps of pumping a formation fluid sample through an analyzer, analyzing the formation fluid sample by illuminating the formation fluid sample with light from a light source and detecting light passing through the formation fluid sample, and measuring the detected light to produce one or more filtrate markers, producing at least two filtrate markers from the analysis, and converting the at least two filtrate markers by vector rotation to a unique orthogonal synthetic fingerprint. In an embodiment, a first pumped fluid sample is analyzed giving initial plateau readings that are a proxy for 100% drilling fluid wherein all fluid pumped thereafter (the pumpout) is analyzed giving readings that are referenced to the first pumped fluid initial plateau for a discrete calculation of percent contamination. In an embodiment, the percent contamination is obtained without curve fitting the readings following the initial plateau over time. In an embodiment, the step of analyzing the formation fluid sample is conducted downhole. In an embodiment, the method of analyzing a synthetic mud contaminated formation fluid utilizing spectroscopy is continuous. In an embodiment, the formation fluid sample includes formation fluid and mud filtrate. In an embodiment the formation fluid sample includes of from 10% to 90% of formation fluid. In a further embodiment the formation fluid sample is obtained from a formation, sent to the analyzer, subjected to analysis, and then returned to the wellbore downhole. In an embodiment, the formation fluid sample is not removed from the downhole environment during the method of measuring.

In another embodiment, the light emitted from the light source emits a wide range of wavelengths in order to obtain an overall spectral signal of the pumpout. In a further embodiment, the light emitted from the light source is IR light in the mid-range, or MIR. In another embodiment, the light emitted from the light source includes IR light in the near-range, NIR, and MIR. In an alternative embodiment, the light emitted includes a wide range of wavelengths in order to obtain an overall spectral signal of the pumpout and includes light of a sufficient wavelength to detect esters, ketones and/or olefins. In a further embodiment the pumpout is analyzed by obtaining a formation fluid sample from a formation, sending the sample to the analyzer to be subjected to analysis by illumination with an IR light source, and then returned to the wellbore downhole. In an embodiment, the downhole fluid sample is not removed from the downhole environment during the method of measuring. In an embodiment, the analyzing of the pumpout produces one or more filtrate markers.

In an embodiment, the method of analyzing a synthetic mud contaminated formation fluid utilizing spectroscopy includes the step of analyzing the downhole fluid sample by using a combination of spectral and non-spectral signals.

The present invention also includes a downhole tool capable of detecting the amount of drilling fluid in a formation fluid sample directly in a downhole environment. The downhole tool includes a pump, an analyzer, and a probe, wherein the probe obtains formation fluid from a formation, the pump pulls formation fluid from the probe through analyzer and out of the downhole tool, keeping the formation fluid in the downhole environment. In an embodiment, the analyzer contains a spectrometer containing a light source and a detector. In an embodiment, the light source is an IR light source. In an embodiment, the IR light source emits IR light in the mid-infrared, MIR, range. In an embodiment, the analyzer is capable of detecting spectral signals and non-spectral signals. In an embodiment, the non-spectral signals are obtained from non-spectroscopic sensors selected from the group of fluorescence to detect double bonds, acoustic measurements, density measurements, and fluid conductivity and combinations thereof.

Figure 6:
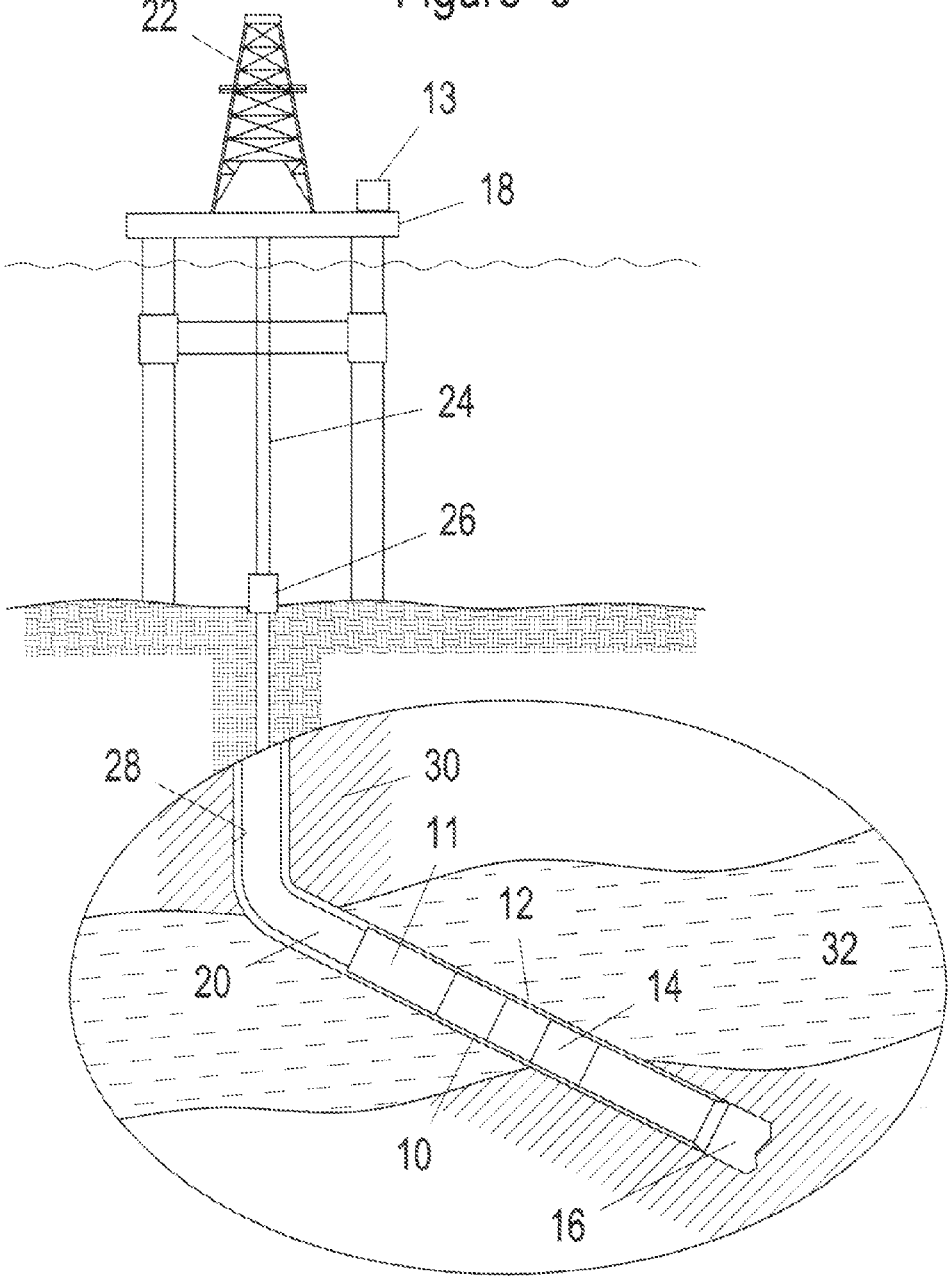
FIG. 6 illustrates a partial schematic and partial cross sectional side view of a wellbore containing a downhole tool of the invention and a processor that are components of a system of the present invention.

FIG. 6 schematically depicts a downhole formation fluid identification tool 10. In an embodiment an optional processor 11 is part of a bottomhole assembly 12, which includes a sub 14 and a drill bit 16 positioned at the distal most end of the formation fluid identification tool 10. During operation, as shown, the bottomhole assembly 12 is lowered from a drilling platform 18, such as a ship or other conventional platform, via a drill string 20. The drill string 20 is disposed through a riser 24 and a wellhead 26. Conventional drilling equipment (not shown) can be supported within a derrick 22 and can rotate the drill string 20 and the drill bit 16, causing the bit 16 to form a borehole 28 through the formation material 30. The drilled borehole 28 penetrates subterranean zones or reservoirs, such as reservoir 32. In an embodiment of the present invention, the formation fluid identification tool 10 may be used with a downhole processor 11, or an above ground processor 13, or a combination thereof. According to embodiments of the present invention, the formation fluid identification tool 10 and processor 11 or 13, may be employed in other bottom hole assemblies and with other drilling apparatus in land-based drilling as well as offshore as depicted.

The processor can be a computer-based processor and data can be transmitted between the formation fluid identification tool and the processor in any suitable manner. If a downhole processor is used the resulting data from the downhole processor can be transmitted to the surface in any suitable manner, such as by electrical transmission through wireline or the tubular string, pulse signals, pressure signals, etc.

An embodiment of the invention is a system for determining filtrate contamination in a formation fluid having a downhole tool with at least one sensor to sense formation fluid samples and a processor coupled to the at least one sensor. The processor can analyze the formation fluid samples to produce at least two filtrate markers from data obtained from the sensor and can convert the at least two filtrate markers by vector rotation to a substantially orthogonal signal.

The processor can analyze a first pumped formation fluid sample giving initial plateau readings that are used as a proxy for 100% drilling fluid having an initial sufficiently orthogonal signal. Signals from subsequent samples are converted by the computer processor to sufficiently orthogonal signals that are referenced to the initial sufficiently orthogonal signal of the first pumped formation fluid sample to give a calculation of percent contamination of the formation fluid.

The sensors used in the system can be selected from the group consisting of ketone based, olefin based, amide based, phosphorus based, amine based, thiocyanate based, ester based, spectroscopic based, non-spectroscopic based, fluorescence based, acoustic based, density based, fluid conductivity based, and combinations thereof. The sensors can use spectral signals, non-spectral signals, or combinations of spectral and non-spectral signals, wherein the signals are stacked.

The system can determine percent contamination without curve fitting the filtrate markers over time to predict the percent contamination at a given point in time.

EXAMPLES

Example 1

Figure 7:
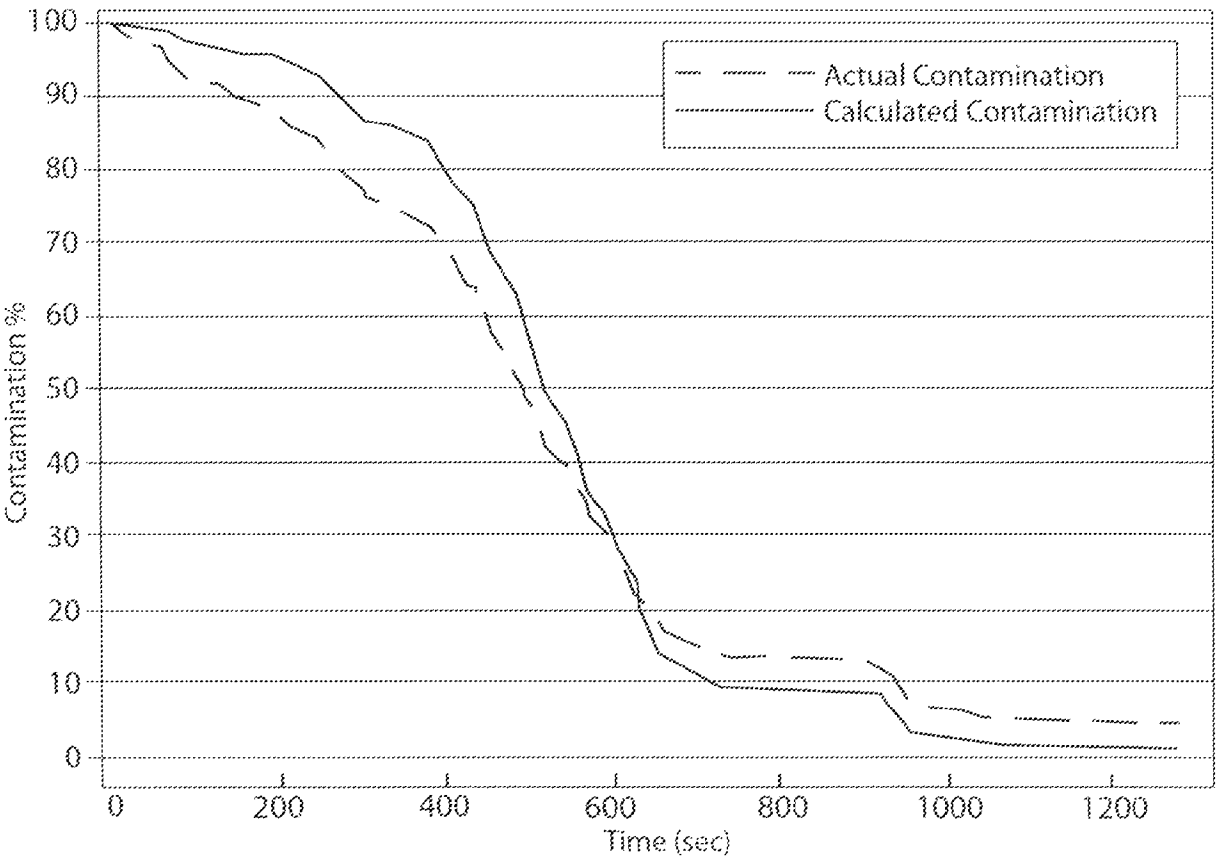
FIG. 7 depicts the response in a measured system versus time.

In Example 1 a mixing study was conducted in which a 12 API gravity oil was mixed with a diesel based mud filtrate in a flow loop varying concentration from pure diesel to low contamination oil. The oil and diesel spectra pure end members are known and were used to determine contamination via a high resolution laboratory spectrometer. Contamination varied from 100% to approximately 4%. Nonlinearity was less than 6%, which showed that the transmission cell configuration was robust (less than 10% is often considered acceptable). In the 21 minute test data was collected every 1 second. Once data was collected it was fed to a simulated real time processing contamination determination algorithm based on multivariate curve resolution. In the algorithm the 100% contamination spectra is assumed to be known at early time in the flow experiments, but no assumptions about the oil spectra were made. The change in spectra is assumed to be due to a gradation between diesel and oil, and the oil spectra is calculated based on the change in spectra and a few natural constraints (the spectra for oil and diesel must be positive, and the diesel mud filtrate have no asphaltene component). The MCR algorithm determined a final concentration of approximately 2% contamination. The calculated results are plotted in FIG. 7 along with the known contamination value versus time. FIG. 7 shows a close match between the calculated real time contamination utilizing the MCR algorithm method described herein and the known contamination curve.

The term "base oil" refers to the base fluid, or oil, of the drilling fluid.

The term "drilling fluid," or "drilling mud," refers to a fluid used to drill boreholes in the earth.

The term "drilling fluid filtrate," or "mud filtrate," refers to the liquid components of drilling mud that can penetrate into a permeable formation, leaving behind solid mud cake.

The term "filtrate marker" refers to some signal response that can be correlated to a particular component of drilling mud or to a particular property of the drilling mud.

The term "orthogonal" means the dot product between different signals is zero. Multiple signals are mutually orthogonal only if the dot products of all possible pairs of different signals are zero.

The term "sufficiently orthogonal" means that there is the indication of an orthogonal relationship between different signals, but that the dot products of all possible pairs of the different signals may not be zero.

The term "pumpout" refers to the fluid samples taken during the sampling of downhole fluids.

The term "spectroscopy", or "spectrometry," is a spectroscopic method used to evaluate the concentration or amount of a given chemical species in a sample.

The term "spectrometer" refers to the instrument that performs spectroscopy.

While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee.

Depending on the context, all references herein to the "invention" may in some cases refer to certain specific embodiments only. In other cases it may refer to subject matter recited in one or more, but not necessarily all, of the claims. While the foregoing is directed to embodiments, versions and examples of the present invention, which are included to enable a person of ordinary skill in the art to make and use the inventions when the information in this patent is combined with available information and technology, the inventions are not limited to only these particular embodiments, versions and examples. Also, it is within the scope of this disclosure that the aspects and embodiments disclosed herein are usable and combinable with every other embodiment and/or aspect disclosed herein, and consequently, this disclosure is enabling for any and all combinations of the embodiments and/or aspects disclosed herein. Other and further embodiments, versions and examples of the invention may be devised without departing from the basic scope thereof and the scope thereof is determined by the claims that follow.

The invention claimed is:

1. A method of detecting synthetic mud filtrate or determining filtrate contamination in a downhole fluid, comprising:

placing a downhole tool into a wellbore;

introducing a downhole fluid sample into the downhole tool; analyzing the downhole fluid sample in the downhole tool;

producing at least two filtrate markers from the analyzing of the downhole fluid sample; and converting the at least two filtrate markers by vector rotation to a sufficiently orthogonal signal.

2. The method of claim 1, wherein the analyzing comprises analyzing a first pumped fluid sample giving initial plateau readings that are a proxy for 100% drilling fluid having an initial sufficiently orthogonal signal.

3. The method of claim 2, wherein subsequent samples pumped after the first pumped fluid sample are converted to sufficiently orthogonal signals that are referenced to the initial sufficiently orthogonal signal of the first pumped fluid sample to give a calculation of percent contamination of the formation fluid.

4. The method of claim 1, wherein the analyzing comprises illuminating the downhole fluid sample with light from a light source and detecting light passing through the downhole fluid sample, and measuring the detected light to produce one or more filtrate markers.

5. The method of claim 4, wherein the light emitted from the light source is of a sufficient wavelength to detect components selected from the group consisting of esters, ketones, olefins, amides, phosphorus, amines, thiocyanate, and combinations thereof.

6. The method of claim 4, wherein the light source is an infrared light source producing infrared light.

7. The method of claim 6, wherein the infrared light comprises wavelengths in the mid-infrared range.

8. The method of claim 1, wherein the analyzing comprises using non-spectroscopic sensors selected from the group of ketone based, olefin based, amide based, phosphorus based, amine based, thiocyanate based, ester based, and combinations thereof.

9. The method of claim 3, wherein the percent contamination is obtained without curve fitting the filtrate markers over time to predict the percent contamination at a given point in time.

10. A system for determining filtrate contamination in a formation fluid, comprising:

a downhole tool comprising at least one sensor to sense formation fluid samples;

a processor coupled to the at least one sensor;

wherein the processor is configured to analyze the formation fluid samples to produce at least two filtrate markers from data obtained from the at least one sensor and convert the at least two filtrate markers by vector rotation to a substantially orthogonal signal.

11. The system of claim 10, wherein the processor is configured to analyze a first pumped formation fluid sample giving initial plateau readings that are a proxy for 100% drilling fluid having an initial sufficiently orthogonal signal.

12. The system of claim 11, wherein signals from subsequent samples pumped after the first pumped formation fluid sample are converted by the computer processor to sufficiently orthogonal signals that are referenced to the initial sufficiently orthogonal signal of the first pumped formation fluid sample to give a calculation of percent contamination of the formation fluid.

13. The system of claim 10, wherein the sensors are selected from the group consisting of ketone based, olefin based, amide based, phosphorus based, amine based, thiocyanate based, ester based, spectroscopic based, non-spectroscopic based, fluorescence based, acoustic based, density based, fluid conductivity based, and combinations thereof.

14. The system of claim 10, wherein the sensors use spectral signals, non-spectral signals, or combinations of spectral and non-spectral signals, wherein the signals are stacked.

15. The system of claim 10, wherein the percent contamination is obtained without curve fitting the filtrate markers over time to predict the percent contamination at a given point in time.

16. A method of analyzing a synthetic mud contaminated formation fluid utilizing spectroscopy, comprising:

placing a downhole tool into a wellbore;

introducing a formation fluid sample into the downhole tool;

analyzing the formation fluid sample in the downhole tool by illuminating the formation fluid sample by light emitting from a light source;

detecting light that passes through the downhole fluid sample;

measuring the detected light to produce at least two filtrate markers; and converting the at least two filtrate markers by vector rotation to a sufficiently orthogonal signal.

17. The method of claim 16, wherein the analyzing comprises analyzing a first pumped formation fluid sample giving initial plateau readings that are a proxy for 100% drilling fluid having an initial sufficiently orthogonal signal.

18. The method of claim 17, wherein subsequent samples pumped after the first pumped formation fluid sample are converted to sufficiently orthogonal signals that are referenced to the initial sufficiently orthogonal signal of the first pumped formation fluid sample to give a calculation of percent contamination of the formation fluid.

19. The method of claim 16, wherein the light emitted from the light source is of a sufficient wavelength to detect components selected from the group consisting of esters, ketones, amides, phosphorus, amines, thiocyanates, olefins, and combinations thereof.

20. The method of claim 16, wherein the analyzing further comprises using non-spectroscopic sensors selected from the group consisting of ketone based, olefin based, amide based, phosphorus based, amine based, thiocyanate based, ester based, fluorescence based, acoustic based, density based, fluid conductivity based, and combinations thereof.

21. The method of claim 16, wherein the analyzing is performed using spectral signals, non-spectral signals, or combinations of spectral and non-spectral signals, wherein the signals are stacked.

22. The method of claim 16, wherein the percent contamination is obtained without curve fitting the filtrate markers over time to predict the percent contamination at a given point in time.

* * * * *